US009713364B2

(12) United States Patent
Simmons

(10) Patent No.: US 9,713,364 B2
(45) Date of Patent: Jul. 25, 2017

(54) FOOT HABILIMENT WITH EASILY INTERCHANGEABLE OUTER

(71) Applicant: Alyssa Ashley Simmons, Hobart, IN (US)

(72) Inventor: Alyssa Ashley Simmons, Hobart, IN (US)

( * ) Notice: Subject to any disclaimer, the term of this patent is extended or adjusted under 35 U.S.C. 154(b) by 61 days.

(21) Appl. No.: 14/621,883

(22) Filed: Feb. 13, 2015

(65) Prior Publication Data

US 2015/0230556 A1 Aug. 20, 2015

Related U.S. Application Data

(60) Provisional application No. 61/939,854, filed on Feb. 14, 2014.

(51) Int. Cl.

| | |
|---|---|
| ***A41D 17/00*** | (2006.01) |
| ***A43B 5/00*** | (2006.01) |
| ***A43B 23/24*** | (2006.01) |
| ***A43B 3/18*** | (2006.01) |
| ***A43B 3/24*** | (2006.01) |

(52) U.S. Cl.

CPC ..... *A43B 23/24* (2013.01); *A43B 3/18* (2013.01); *A43B 3/242* (2013.01)

(58) Field of Classification Search

CPC .. A43B 3/02; A43B 3/18; A43B 3/242; A43B 23/24

USPC ..... 36/1.5, 101

See application file for complete search history.

(56) References Cited

U.S. PATENT DOCUMENTS

| | | | | | |
|---|---|---|---|---|---|
| 324,719 | A * | 8/1885 | Moore | A43C 7/00 | 24/712.4 |
| 888,745 | A * | 5/1908 | Rosenwasser | A43B 3/02 | 36/1.5 |
| 1,442,392 | A * | 1/1923 | Gantenbein | A43B 3/02 | 36/1.5 |
| 1,725,597 | A * | 8/1929 | Rogers | A41D 17/00 | 36/1.5 |
| 4,856,207 | A * | 8/1989 | Datson | A43B 23/06 | 36/1.5 |
| 4,896,437 | A * | 1/1990 | Johnson | A43B 23/06 | 2/22 |
| 5,692,319 | A * | 12/1997 | Parker | A43B 7/1495 | 36/114 |
| 5,778,564 | A | 7/1998 | Kettner | | |
| 6,301,803 | B1 * | 10/2001 | Patterson | A41D 17/00 | 36/1.5 |
| D516,284 | S * | 3/2006 | Andrews-Kramer | D2/970 | |
| 8,413,351 | B1 | 4/2013 | Watters et al. | | |
| 2005/0268496 | A1 | 12/2005 | Bruce et al. | | |

* cited by examiner

*Primary Examiner* — Jila M Mohandesi

(74) *Attorney, Agent, or Firm* — Wood, Phillips, Katz, Clark & Mortimer

(57) ABSTRACT

A foot habiliment (1) that allows for easily interchanging an outer (5) with varying designs and features (4). The foot habiliment (1) takes no steps to conceal the fact that an interchangeable outer is being worn and does not take away from the functionality of the body (3) of the foot habiliment. The interchangeable outer (5) attaches to the foot habiliment (1) by a cord (21) threaded through a loop (23) on the foot habiliment (1), the ends of the cord (21) being attached to the respective edges of the outer (5). This arrangement allows the user to easily remove and replace the outer with another having a different design or decoration.

20 Claims, 3 Drawing Sheets

FOOT HABILIMENT WITH EASILY INTERCHANGEABLE OUTER

CROSS-REFERENCE TO RELATED APPLICATIONS

The present application claims the benefit of U.S. Provisional Patent Application No. 61/939,854, filed Feb. 14, 2014, the entirety of which is hereby incorporated by reference.

BACKGROUND

People have been wearing articles of clothing since the beginning of time. The oldest known clothing for the feet, mere foot bags, were found in 3,500 B.C. Today, there are many types of shoes and boots that are worn on the feet. One notable type of boot is the Wellington boot, popularly attributed to Arthur Wellesley, 1st Duke of Wellington who made the boots fashionable in the early $19^{th}$ century. The fashion and function of such habiliments for the feet, such as boots, has not progressed tremendously since the time of Wellington.

Footwear, boots for example, are mass produced with a single fashion. People buying boots to wear in different fashion styles will necessarily buy more than one pair. Children's footwear will often have attractive features, such as fun designs. If parents or children want different fashion styles or attractive features they will need to buy more than one pair. Buying multiple pairs of boots is expensive. Often the fashions desired can only be accommodated via mass produced single fashion designs, such as a straight line appearance on the back of a long boot.

Information relevant to attempts to address these problems can be found in U.S. Pat. No. 5,778,564 (Kettner) and U.S. Pat. No. 8,413,351 (Watters et al.). However, each one of these references suffers from one or more of the following disadvantages: the systems are not generally usable without the interchangeable covers, the attachment mechanisms are difficult to use, and importantly the attachment mechanisms are designed to be hidden from view.

For the foregoing reasons, there is a need in the industry for footwear, such as boots to name one example, with fashion styles or attractive features that can be easily and quickly interchanged on a single pair of footwear. There is also a need in the industry for a foot habiliment that allows for different styles and features to be bought inexpensively. The different styles and features should provide an appearance that looks well put together or adds other desired features to the boot without a need to conceal the fact that an interchangeable cover is being used.

SUMMARY

The present invention is directed to an apparatus that satisfies these needs, the utility of which is to allow a wearer of habiliments for feet, boots for example, to inexpensively, easily and quickly change the design and features of the footwear. An embodiment of the apparatus comprises a habiliment for a foot having an interchangeable outer. One embodiment of the invention provides a neat, clean, high quality appearance such as straight lines along the backside of a long boot.

A foot habiliment, preferably a boot, having features of the present invention comprises a body, which is fully functional as footwear by itself, and an interchangeable outer. The interchangeable outer having a first edge and a second edge. The first edge being located generally opposite to the second edge similar to opposite edges of a rectangle. The interchangeable outer having a position generally oriented with the body. The interchangeable outer being removably engaged with the body by at least partially wrapping the body and having the first edge adjacent to the second edge. Once being wrapped around the body, the first edge and the second edge become generally aligned with the vertical axis of the body. Preferably, there is a gap that appears between the edges. At least one first button that is attached to the interchangeable outer along the first edge. At least one second button that is similarly attached to the interchangeable outer along the second edge. At least one loop that is attached to the body, it can be attached to a boot at manufacture or attached to a pre-manufactured boot, and is generally aligned with the at least one first button and the at least one second button. At least one cord that is attached to the interchangeable outer near to the at least one first button. Preferably this would give the false appearance that the cord is attached to the at least one first button itself. The at least one cord extending through the at least one loop and a second end of the at least one cord being removably attached to the at least one second button, attaching can be done in many ways but preferably it is looped around the button.

In an effort to provide a way for the user of the invention to easily change the appearance of the cover, such a foot habiliment could further comprise the interchangeable outer having at least one stratum, that is several layers of material. The at least one stratum having at least one design fixed on a face of the at least one stratum. The design might be a color, pattern, picture, or even a functional design such as a feature allowing for a user to write with chalk onto the face. In a situation where there is more than one stratum, the interchangeable outer could be more easily interchanged by merely reversing the interchangeable outer. An embodiment is capable of having various designs, such as differently printed graphics or different shapes, to name a few examples. An embodiment is foreseen allowing users the ability to custom design the wrap. Printed graphics or functional surfaces, those used on chalk boards or white boards to name a few examples, can be applied in various ways known to those in the art.

Because the interchangeable outer is wrapped freely around the body, such a foot habiliment could further comprise the interchangeable outer being made from a pliable material. The material might be canvas, cloth, rubber, vinyl, or the like. The interchangeable outer is easy to maintain and store.

The inventor has discovered that boots have certain portions that go through a lot of bending as a person walks with the boots which could cause a cover to slip and slide, such a foot habiliment could further comprise an interchangeable outer that stays generally in place whenever the body bends. One way this is done is by having the proper shape of the cover to match the portions of the boot that bend.

Another embodiment of a foot habiliment, preferably a boot, having features of the present invention comprises also at least one decorative bow attached to the body. The bow furthers the appearance that the cover is not intended to be hidden by attracting a viewer's attention to that fact.

Notably, one embodiment of the invention comprises a button and loop system for firmly securing the interchangeable outer to the body. This method makes changing the interchangeable outer very easily done. There are other ways to connect the body and interchangeable outer, hooks or clasps or buckles might be used as buttons for instance. The number of buttons used in any embodiment is unlimited. The inventor has determined that the preferred embodiment would have the various buttons aligned along the adjacent edges of the cover, however, an embodiment of the invention can work with the buttons in other locations too.

Additional features inherent in an embodiment of the invention include a cord that is capable of use regardless of the stratum face that is showing, the interchangeable outer need not be one piece construction. Preferably, the at least one first button is a decorative button which gives an appearance that there are actually two functioning buttons and one cord working to fasten the wrap, however the decorative button could also be functioning if the cord were differently attached.

BRIEF DESCRIPTION OF THE SEVERAL VIEWS OF THE DRAWINGS

These and other features, aspects and advantages of the present invention will become better understood with regard to the following description, appended claims, and accompanying drawings where:

DESCRIPTION

Overview.

Figure 1:
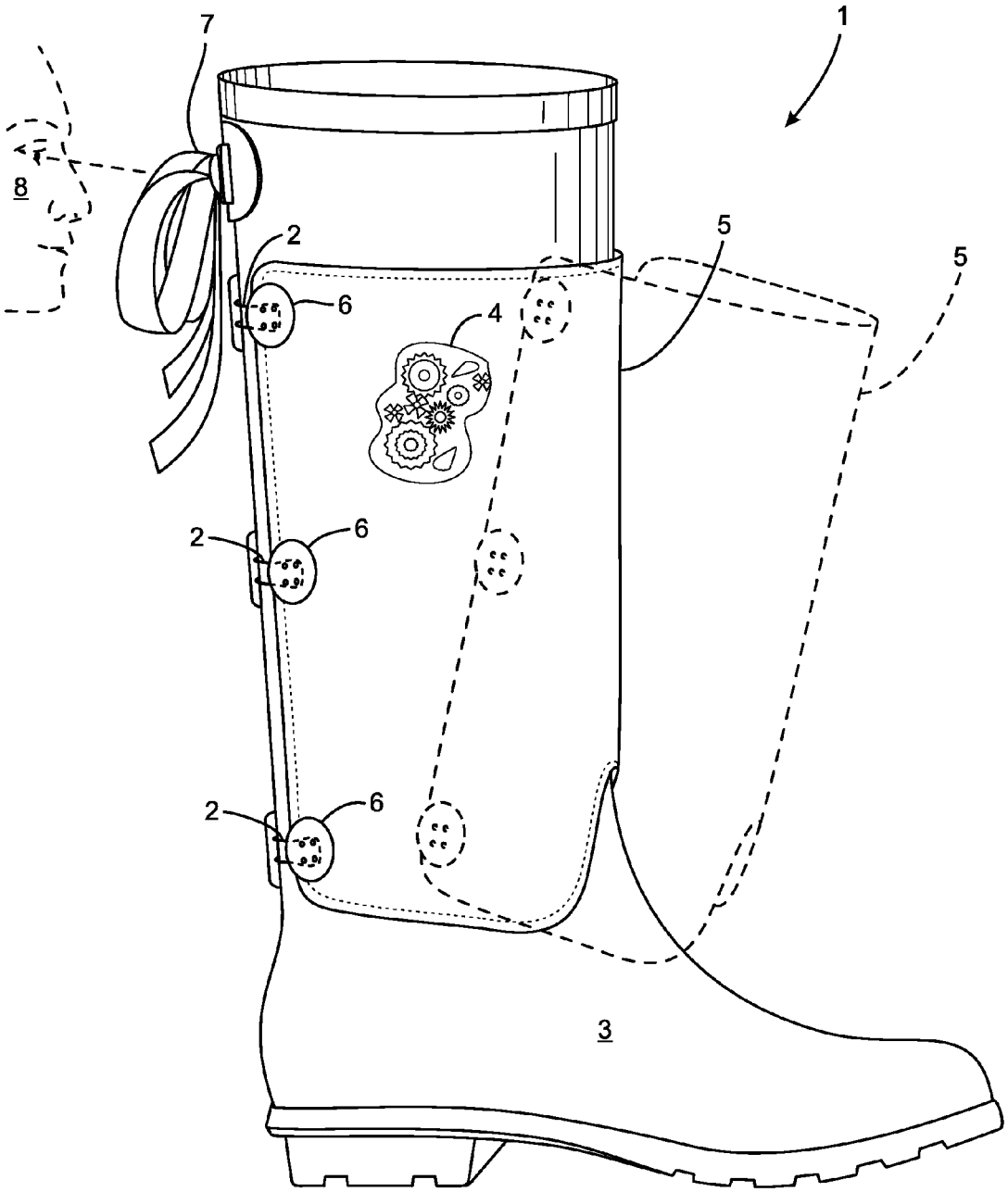
FIG. 1 shows a perspective view of an apparatus embodying features of the present invention foot habiliment with easily interchangeable outer.

As shown in FIG. 1, an apparatus embodying features of the present invention foot habiliment with easily interchangeable outer 1 comprises a body 3 and an interchangeable outer 5. At least one button 6 being attached to the wrap 5, a cord 2 looped around the at least one button 6. A stratum face presenting a design 4. A decorative bow 7 is attached to the body and draws an onlooker's attention to the cover itself 8.

Figure 2:
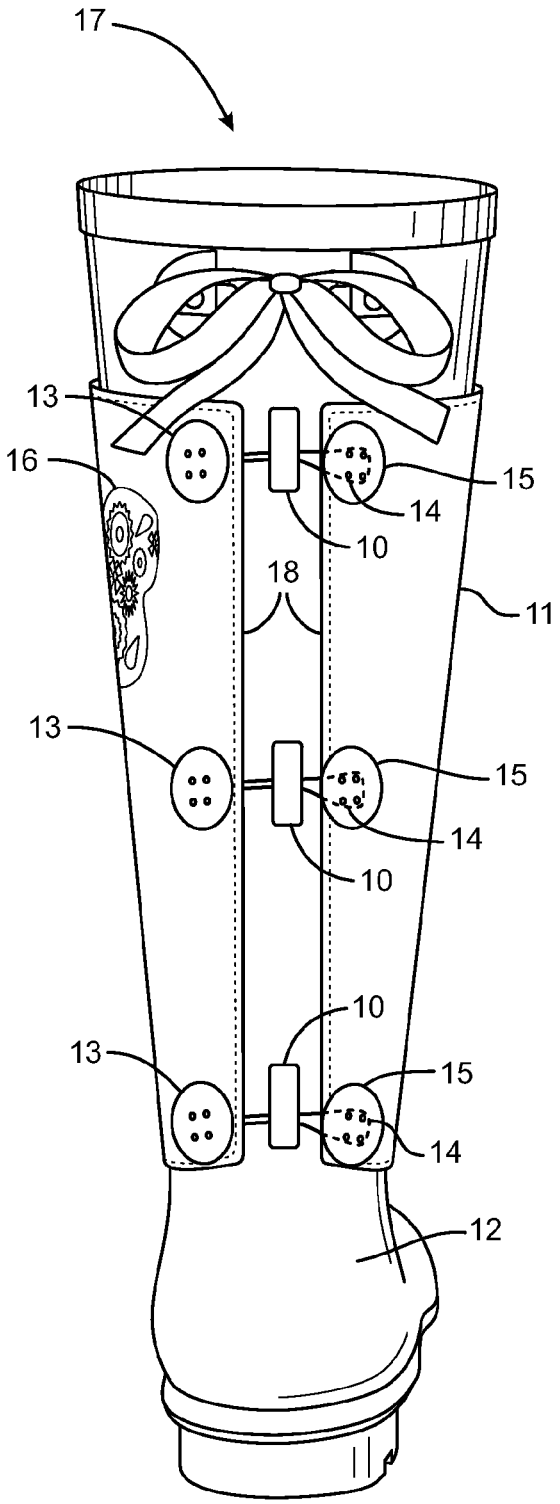
FIG. 2 shows a perspective view of another version of an apparatus embodying features of the present invention foot habiliment with easily interchangeable outer, illustrated to show an interchangeable outer that is firmly secured in the back of a boot.

As shown in FIG. 2, another version of an apparatus embodying features of the present invention foot habiliment with easily interchangeable outer, illustrated to show an interchangeable outer that is firmly secured in the back of a boot comprises a body 12 and an interchangeable outer 11 having imprinted upon it a design 16. The wrap 11 is attachable and detachable to the body 12 and is partially wrapping the body 12. The edges of the interchangeable outer 18 being vertically aligned with the boot's vertical axis and forming a gap that allows the body 12 to be seen 17. The interchangeable outer 11 being securely fastened to the body 12 by using at least one button 13. A cord 14 is attached to the interchangeable outer 11 near the at least one button 13. The cord 14 extends through the at least one loop 10 and loops around a second button 15.

Figure 3:
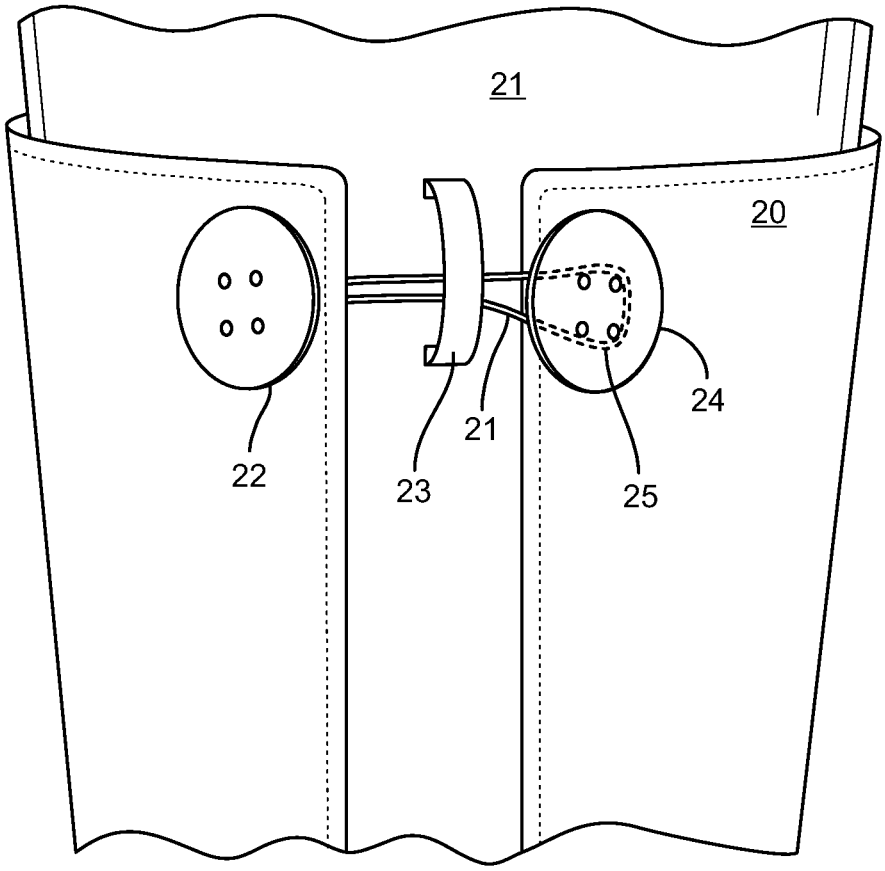
FIG. 3 shows a perspective view of another version of an apparatus embodying features of the present invention foot habiliment, illustrated to show the workings of the button and cord fastening elements.

As shown in FIG. 3, another version of an apparatus embodying features of the present invention foot habiliment, illustrated to show the workings of the button and cord fastening elements comprises a boot 21 with an interchangeable outer attached 20. The button 22 attached to the interchangeable outer is decorative. The cord 21 is attached to the interchangeable outer, being sewn for instance, and extends through a loop 23 that is attached to the boot 21. The cord 21 is attached to the second button 24 using a hook 25.

Although the present invention has been described in considerable detail with the reference to certain preferred versions thereof, other versions are possible. For example the buttons can be some other type of fastener that is quick and easy to use, the cord could be some other type of extender that will firmly secure the interchangeable outer to the body. Therefore, the spirit and scope of the appended claims should not be limited to the description of the preferred versions contained herein.

Insofar as the description above and the accompanying drawings disclose any additional subject matter that is not within the scope of the claims below, the inventions are not dedicated to the public and the right to file one or more applications to claim such additional inventions is reserved.

What I claim is:

1. A foot habiliment having an interchangeable outer, the foot habiliment comprising: (a) a body having a front and a rear, a top and a bottom, and a sole; (b) the interchangeable outer having a first edge; (c) the interchangeable outer having a second edge; (d) the first edge being located generally opposite to the second edge; (e) the interchangeable outer having a position generally oriented with the body; (f) the interchangeable outer being removably engaged with the body by at least partially wrapping the body and having the first edge adjacent to the second edge; (g) the first edge and the second edge being generally aligned with the vertical axis of the body and positioned at the rear of the body; (h) at least one first button; (i) the at least one first button being attached to the interchangeable outer along the first edge; (j) at least one second button; (k) the at least one second button being attached to the interchangeable outer along the second edge; (l) at least one loop positioned on the rear of the body of the foot habiliment; (m) the at least one loop being attached to the rear of the body adjacent the first and second edges of the interchangeable outer; (n) the at least one loop being aligned with both the at least one first button and the at least one second button; (o) at least one cord; (p) a first end of the at least one cord being attached to the interchangeable outer proximate to the at least one first button; (q) the at least one cord extending through the at least one loop; (r) a second end of the at least one cord being removably attached to the at least one second button; (s) the interchangeable outer having a third edge located between the first and second edges and extending from the first and second edges, the third edge including a notch, the notch located adjacent to where the foot habiliment bends when a wearer of the foot habiliment walks.

2. The foot habiliment of claim 1 further comprising: (a) the interchangeable outer having at least one stratum; (b) the at least one stratum having at least one design fixed on a face of the at least one stratum.

3. The foot habiliment of claim 2, wherein the interchangeable outer includes a second stratum; the second stratum having at least one second design fixed on a face of the second stratum; said interchangeable outer displaying the at least one second design when the first stratum is facing the body, and displaying the at least one first design when the second stratum is facing the body.

4. The foot habiliment of claim 1 wherein the interchangeable outer is made from a pliable material.

5. The foot habiliment of claim 1 wherein the interchangeable outer stays generally in place whenever the body bends.

6. The foot habiliment of claim 1 wherein the body is a boot.

7. The foot habiliment of claim 1 wherein the interchangeable outer is easily interchanged.

8. The foot habiliment of claim 1, wherein the interchangeable outer is located on the body between the sole and top of the body and does not extend below the sole or above the top of the body.

9. A foot habiliment having an interchangeable outer, the foot habiliment comprising: (a) a body including a sole; (b) the interchangeable outer having a first edge; (c) the interchangeable outer having a second edge; (d) the first edge being located generally opposite to the second edge; (e) the interchangeable outer having a position generally oriented with the body: (f) the interchangeable outer being removably engaged with the body by at least partially wrapping the body and having the first edge adjacent to the second edge, the first edge and second edge being aligned and opposing each other along a rear surface of the body; (g) the first edge and the second edge being generally aligned with the vertical axis of the body; (h) at least one first button; (i) the at least one first button being attached to the interchangeable outer along the first edge; (j) at least one cord; (k) a first end of the at least one cord being attached to the interchangeable outer along the second edge at an area of attachment; (l) at least one loop; (m) the at least one loop being attached to the rear of the body; (n) the at least one loop being horizontally aligned with the at least one first button and the area of attachment of the cord; (o) the at least one cord extending through the at least one loop; (p) a second end of the at least one cord being removably attached to the at least one first button.

10. The foot habiliment of claim 9, further including: (a) the interchangeable outer having at least one stratum; (b) the at least one stratum having at least one design fixed on a face of the at least one stratum; (c) the interchangeable outer being made from a pliable material; (d) the interchangeable outer staying generally in place whenever the body bends.

11. The foot habiliment of claim 9, wherein the interchangeable outer does not contact the sole of the foot habiliment.

12. The foot habiliment of claim 9, wherein the interchangeable outer includes a third edge, the third edge including a notch, said notch receiving an instep of the foot habiliment when the interchangeable outer is engaged to the body.

13. A foot habiliment having an interchangeable outer, the foot habiliment comprising: (a) a body; (b) the interchangeable outer having a first edge; (c) the interchangeable outer having a second edge; (d) the first edge being located generally opposite to the second edge; (e) the interchangeable outer having a position generally oriented with the body; (f) the interchangeable outer being removably engaged with the body by at least partially wrapping the body and having the first edge adjacent to the second edge; (g) the first edge and the second edge being generally aligned with the vertical axis of the body along the rear of the body; (h) at least one first button; (i) the at least one first button being attached to the interchangeable outer along the first edge; (j) at least one cord; (k) a first end of the at least one cord being attached to the interchangeable outer at an area of attachment proximate the second edge; (l) at least one loop; (m) the at least one loop being attached to the rear of the body; (n) the at least one loop being aligned with both the at least one first button and the area of attachment of the first end of the cord; (o) the at least one loop being between the at least one first button and the area of attachment of the first end of the cord.

14. The foot habiliment of claim 13 wherein there is at least one decorative bow attached to the body.

15. The foot habiliment of claim 13 wherein the interchangeable outer is easily interchanged.

16. The foot habiliment of claim 13 wherein the interchangeable outer includes at least one stratum.

17. The foot habiliment of claim 16 wherein the interchangeable outer includes at least one design affixed to the at least one stratum.

18. The foot habiliment of claim 13 wherein the interchangeable outer is made of a pliable material.

19. The foot habiliment of claim 13 wherein the interchangeable outer stays in place when the body bends.

20. The foot habiliment of claim 13, wherein the interchangeable outer is rectangular in shape and including a third edge and a fourth edge, the third edge of the rectangle including a notch, the notch receiving the instep of the body when the interchangeable outer is positioned on the body.

* * * * *